US006620058B2

(12) United States Patent
Halko et al.

(10) Patent No.: US 6,620,058 B2
(45) Date of Patent: Sep. 16, 2003

(54) WOUND GOLF BALL WITH HIGH RESILIENCE FOR LOW SWING SPEED PLAYERS

(75) Inventors: Roman D. Halko, Natick, MA (US); Laurent Bissonnette, Portsmouth, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/733,928

(22) Filed: Dec. 12, 2000

(65) Prior Publication Data

US 2003/0036443 A1 Feb. 20, 2003

(51) Int. Cl.[7] ..... A63B 37/06; A63B 37/07

(52) U.S. Cl. ..... 473/356; 473/357; 473/377; 473/361; 473/36.5; 473/35.6; 473/374

(58) Field of Search ..... 273/DIG. 10; 473/356, 473/373, 384, 354, 351; 156/186

(56) References Cited

U.S. PATENT DOCUMENTS

| | | | | | |
|---|---|---|---|---|---|
| 587,764 | A | | 8/1897 | Short | 57/210 |
| 3,097,192 | A | | 7/1963 | Schilit | 57/225 |
| 3,405,516 | A | | 10/1968 | Laurenti | 57/204 |
| 3,616,101 | A | | 10/1971 | Satchell et al. | 161/7 |
| 4,228,641 | A | | 10/1980 | O'Neil | 57/234 |
| 4,469,739 | A | | 9/1984 | Gretzinger et al. | 428/198 |
| 4,473,229 | A | | 9/1984 | Kloppenburg et al. | 273/225 |
| 4,625,964 | A | * | 12/1986 | Yamada | 473/373 |
| 4,763,466 | A | | 8/1988 | Abe et al. | 57/213 |
| 4,783,078 | A | | 11/1988 | Brown et al. | 273/216 |
| 5,033,750 | A | * | 7/1991 | Yamagishi et al. | 473/384 |
| 5,597,649 | A | | 1/1997 | Sandor et al. | 428/370 |
| 5,679,196 | A | | 10/1997 | Wilhelm et al. | 156/167 |
| 5,683,312 | A | | 11/1997 | Boehm et al. | 473/354 |
| 5,685,785 | A | | 11/1997 | Kakiuchi et al. | 473/354 |
| 5,697,856 | A | * | 12/1997 | Moriyama et al. | 473/374 |
| 5,704,853 | A | * | 1/1998 | Maruko et al. | 473/351 |
| 5,713,801 | A | | 2/1998 | Aoyama | 473/354 |
| 5,816,939 | A | | 10/1998 | Hamada et al. | 473/357 |
| 5,827,167 | A | | 10/1998 | Dougan et al. | 473/356 |
| 5,861,465 | A | * | 1/1999 | Hamada et al. | 473/356 |
| 5,885,172 | A | * | 3/1999 | Hebert et al. | 473/354 |
| 5,962,140 | A | | 10/1999 | Rajagopalan | 428/421 |
| 6,030,296 | A | * | 2/2000 | Morgan et al. | 156/186 |
| 6,113,505 | A | * | 9/2000 | Boehm | 156/186 |
| 6,149,535 | A | | 11/2000 | Bissonnette et al. | 473/354 |
| 6,291,592 | B1 | * | 9/2001 | Bulpett et al. | 525/248 |

* cited by examiner

*Primary Examiner*—Paul T. Sewell
*Assistant Examiner*—Tom Duong
(74) *Attorney, Agent, or Firm*—Swidler Berlin Shereff Friedman, LLP

(57) ABSTRACT

The present invention is directed towards a golf ball and a method of making a golf ball which comprises a center, at least one cover layer, and at least one wound layer of a tensioned material windings between the center and the cover. Such golf balls have a coefficient of restitution that is optimized for low swing speed players. Since these players usually swing the club at the ball at low swing speeds, and thus get less distance from the ball off the tee, greater ball resiliency tends to provide greater distance and velocity off the tee. Preferably, the golf ball has a core having a thin wound layer of thread. The wound layer of the present invention may be applied to golf balls having liquid or solid centers to achieve desired golf ball characteristics.

27 Claims, 5 Drawing Sheets

WOUND GOLF BALL WITH HIGH RESILIENCE FOR LOW SWING SPEED PLAYERS

FIELD OF THE INVENTION

This invention relates generally to golf balls, and more specifically, to a wound golf ball. In particular, this invention relates to a golf ball having at least a center, a cover and a wound layer having at least one thread. This invention is also directed to a golf ball where the golf ball has a high resilience for low swing speed players to increase flight distance.

BACKGROUND OF THE INVENTION

Conventional golf balls can be divided into two general groups: solid balls or wound balls. The difference in play characteristics resulting from these different types of construction can be quite significant. Balls having a solid construction are popular with golfers because they provide a very durable ball while also providing maximum distance. Solid balls are generally made with a solid core, usually made of a cross linked rubber, enclosed by a cover material. Typically the solid core is made of polybutadiene which is chemically crosslinked with zinc diacrylate and/or similar crosslinking agents. In addition to one-piece solid cores, solid cores may also contain a number of outer layers,. such as in a dual core golf ball. The cover is generally an ionomeric material, such as SURLYN®, which is a tradename for a family of ionomer resins produced by E.I. DuPont de Nemours & Co. of Wilmington, Del. Covers are typically a single layer but may also include one or more layers, such as in a double cover having an inner and outer cover layer.

The combination of the solid core and ionomeric cover materials provide a ball that is very durable and abrasion resistant. Further, such a combination tends to impart a high initial velocity to the ball, which results in increased distance. Because these materials are very rigid, however, solid balls can have a hard "feel" when struck with a club. Likewise, due to their construction, these balls tend to have a relatively low spin rate, which can provide greater distance and increases accuracy off the tee.

At the present time, wound golf balls are preferred by some golfers for the spin and feel characteristics afforded by such a construction. Wound balls typically have either a spherical solid rubber or liquid center, around which many yards of a tensioned elastomeric thread are wound. The wound core is then covered with a durable cover material, such as SURLYN® or similar material, or a softer cover material, such as balata or polyurethane. Wound balls are generally softer and provide more spin, which enable a skilled golfer to have more control over the ball's flight and landing position. Particularly, with approach shots onto the green, the high spin rate of soft, wound balls enable the golfer to stop the ball very near its landing position.

Regardless of the form of the ball, players generally seek a golf ball that maximizes total game performance. Therefore, in an effort to meet the demands of the marketplace, manufacturers strive to produce golf balls with a wide variety of performance characteristics to meet the players individual requirements. Thus, golf ball manufacturers are continually searching for new ways in which to provide golf balls that deliver the maximum performance for golfers of all skill levels.

To make wound golf balls, manufacturers use winding machines to stretch the elastic threads to various degrees of elongation during the winding process without subjecting the threads to unnecessary incidents of breakage. Generally, as the elongation and the winding tension increases, the compression and initial velocity of the ball increases. Thus, a more resilient wound ball is produced, which is desirable.

For wound golf balls, the thread is typically formed by a calendar and slitting method rather than an extrusion method. The calendared thread typically has a rectangular cross-section, while extruded thread generally has a circular cross-section.

A number of different windings have been disclosed for use in golf balls. U.S. Pat. No. 4,473,229 to Kloppenburg et al. discloses a golf ball having a core formed of graphite fibers and windings made of graphite filaments and resins. Yarns are made with the graphite filaments and resins, and as many as four or more yarns are combined to form a final yarn used for winding. U.S. Pat. No. 5,713,801 to Aoyama discloses use of a layer of high tensile elastic modulus fibers wound about the core. The fibers have a tensile elastic modulus of at least 10,000 ksi (10,000,000 psi). Also, U.S. Pat. No. 5,816,939 to Hamada et al. discloses a rubber thread for winding with a tensile strength retention of at least 70%, a hysteresis loss of no more than 50%, and an elongation of 900 to 1400%.

Prior art wound golf balls and cores typically use polyisoprene rubber thread. The polyisoprene thread is wound onto the cores at elongations between 500 to 1000%. The amount of thread required for a golf ball core is dependent on the elastic modulus of the thread in the elongated state. Elongated polyisoprene thread generally has an elastic modulus of 10,000 psi to 20,000 psi. Further, the properties, in particular resilience, of the wound ball or core are dependent on how well the thread packs during winding. The dimensions of the thread and winding pattern control the packing density. Present art polyisoprene threads are typically at least 1/16 inches wide by 0.02 inches thick, measured prior to winding. However, present art polyisoprene thread is commonly produced in thicknesses between 0.014 inches and 0.024.

U.S. application Ser. No. 09/266,847, filed Mar. 12, 1999, discloses a thread for winding having at least about 10 individual strands that are each at most about 0.01 inches in diameter. Preferably, the thread has more than 25 strands with diameters of less than about 0.002 inches. The smaller thread dimension allows the thread to be wound more densely. Preferably, the elastic modulus of the thread is greater than 20 ksi when wound about a center. Preferably, the maximum elongation of the thread is greater than about 8%.

It is thus desired to prepare golf balls having an improved wound construction to create a ball that achieves improved characteristics for low swing speed players.

SUMMARY OF THE INVENTION

The present invention is directed to a wound golf ball with high resilience for low swing speed players to give them greater distance off the tee while conforming to the USGA golf rules. Methods for measuring the resiliency of golf balls are well known by those of ordinary skill in the art. One method of measuring the resiliency of a ball at impact is to utilize an air cannon or other means of propelling a ball at velocities equivalent to those of a golf club head. The balls are fired at a massive rigid block, with the inbound and outbound velocities being measured. The velocity may be measured by the use of light screens, which measure the time required for the ball to travel a fixed distance. The fixed distance divided by the transit time is equivalent to the average velocity of the ball over the fixed distance. The ratio of the outbound velocity to the inbound velocity is commonly referred to as the coefficient of restitution ("COR"). The COR is a direct measure of the resilience of a golf ball at a particular inbound velocity. Since golf balls behave in a linear-viscoelastic fashion, inbound ball velocity is functionally equivalent to club swing speed. The present invention seeks to maximize the COR for low swing speed players. These players swing the club at the ball with low swing speeds, and thus tend to obtain lower ball velocity after impact and less distance off the tee.

The golf ball according to the present invention includes a wound golf ball comprised of a center, a cover and a layer of windings disposed between the center and the cover. The center of the golf ball may be solid or liquid filled. Preferably, the center is solid. In one embodiment, the golf ball has at least one intermediate layer disposed between the center and the cover, i.e., one or more additional layers on either side of the layer of windings can be included in the golf ball. In another embodiment, the center itself includes more than one layer. The golf ball is wound with at least one thread, and a cover is preferably placed over the windings. Preferably, the center is at least about 1.1 inches. Most preferably, the outer diameter of the center is about 1.2 to 1.5 inches. Preferably, the combination of center and the wound layer has an outer diameter of about 1.4 to 1.63 inches. Thus the wound layer is thin in this embodiment.

In one embodiment, the cover material has at least one of a dimple coverage of greater than about 60 percent, a hardness from about 35 to 80 Shore D, or a flexural modulus of greater than about 500 psi, and the golf ball has a compression from about 50 to 120.

The golf balls according to the present invention are tested by measuring COR as discussed above by launching the golf balls at velocities of 110 ft/s and 160 ft/s+/−0.5 ft/s. Most preferably, the wound golf balls according to the invention have a COR, at 160 ft/s, greater than or equal to 0.76 and a gradient of the COR of at least about 0.001 s/ft, thus resulting in a large increase in resilience as the club swing speed decreases.

The threads may be formed of a suitable material including polyisoprene. Suitable polymers include polyether urea, such as LYCRA®; polyester urea; polyester block copolymers, such as HYTREL®; isotactic-poly(propylene); polyethylene; polyamide; poly(oxymethylene); polyketon; poly(ethylene terephthalate), such as DACRON®; poly(p-phenylene terephthalamide), such as KEVLAR®; poly (acrylonitrile), such as ORLON®; diaminodicyclohexylmethane; and dodecanedicarboxylic acid, such as QUINA®; or combinations thereof. LYCRA®, HYTREL®, DACRON®, KEVLAR®, ORLON®, and QUINA® are available from E.I. DuPont de Nemours & Co. of Wilmington, Del. Glass fiber and, for example, S-GLASS® from Corning Corporation of New York can be included as suitable thread material. Also, D7 Globe thread by Globe Manufacturing of Fall River, Mass. can be included. Most preferably, the golf ball is wound with a polyether urea thread, such as LYCRA®. Preferably, these threads contain at least about 10, more preferably at least about 100 strands. Each strand diameter is on the order of less than about 0.0001 inches. For optimal resilience, the polyether urea thread is elongated from about 200 to 500% to produce threads that are wound and densely wrapped.

The inner sphere, or center, of the golf ball is made of a composition, such as a thermoset solid rubber sphere, a thermoplastic solid sphere, wood, cork, metal, or any other suitable material known or available to one of ordinary skill in the art, or any combinations thereof, such as a rubber/metal multi-layer center. Preferably, the solid inner sphere is formed of a material that includes a resilient polymer such as polybutadiene, natural rubber, polyisoprene, styrene-butadiene, or styrene-propylene-diene rubber. In one embodiment, the center can include more than one layer. Similarly the inner sphere could be a liquid filled sphere or shell such as a rubber sack, a thermoplastic, or metallic shell design, in which the liquid could be of any composition or viscosity. It is also feasible to construct such a center with a void or gas center. In another embodiment, the center can be filled with a liquid, a gel, a paste, a cellular foam, or a gas.

Finally, a cover is molded around the core. The cover can also have one or more layers. Any process that results in accurate and repeatable central placement of the core within the cover is acceptable and preferred. Generally, covers are applied by compression molding, injection molding or casting cover material over the core. In one embodiment, the golf ball weighs less than about 45.93 g, preferably less than about 44 g, and more preferably less than about 42 g. In another embodiment, the golf ball weighs from about 40 g to 44 g, preferably from about 42 g to 44 g.

In one optional embodiment, the invention relates to the golf ball wherein at least one of the center, the cover, or the wound layer includes a material formed from the conversion reaction of an amount of polybutadiene, a free radical source, and a cis-to-trans catalyst, which reaction occurs at a sufficient temperature to form a polybutadiene reaction product which includes an amount of trans-polybutadiene greater than the amount of trans-polybutadiene present before the conversion reaction. In one embodiment, the reaction product has a first dynamic stiffness measured at −50° C. that is less than about 130 percent of a second dynamic stiffness measured at 0° C. The cis-to-trans catalyst preferably includes at least one of a Group VIA element, an inorganic sulfide, an aromatic organic compound, an organosulfur component, or a combination thereof. The cis-to-trans catalyst is typically present in an amount from about 0.01 to 25 parts per hundred of polybutadiene. In one embodiment, the reaction product is disposed in at least a portion of the center or the wound layer. In yet another embodiment, the thread material is tensioned and includes the reaction product. Also included are methods for forming a portion of the golf ball by combining (a) a cis-to-trans catalyst; (b) a free radical source; and (c) a first resilient polymer component including a cis-polybutadiene component present in an amount greater than about 70 percent of the total polymer component, converting a portion of the first resilient polymer component to a second resilient polymer component in about 5 to 18 minutes at a sufficient temperature to convert at least a portion of the cis-polybutadiene component to a trans-polybutadiene component and wherein the polybutadiene in the second resilient polymer component is at least about 10 percent trans-polybutadiene and less than about 7 percent vinyl-polybutadiene, and forming the second resilient polymer component into at least a portion of the center, the wound layer, or the cover of the golf ball.

BRIEF DESCRIPTION OF THE DRAWINGS

Further features and advantages of the invention can be ascertained from the following detailed description that is provided in connection with the drawing(s) described below.

DETAILED DESCRIPTION OF THE PREFERRED EMBODIMENTS

Figure 1:
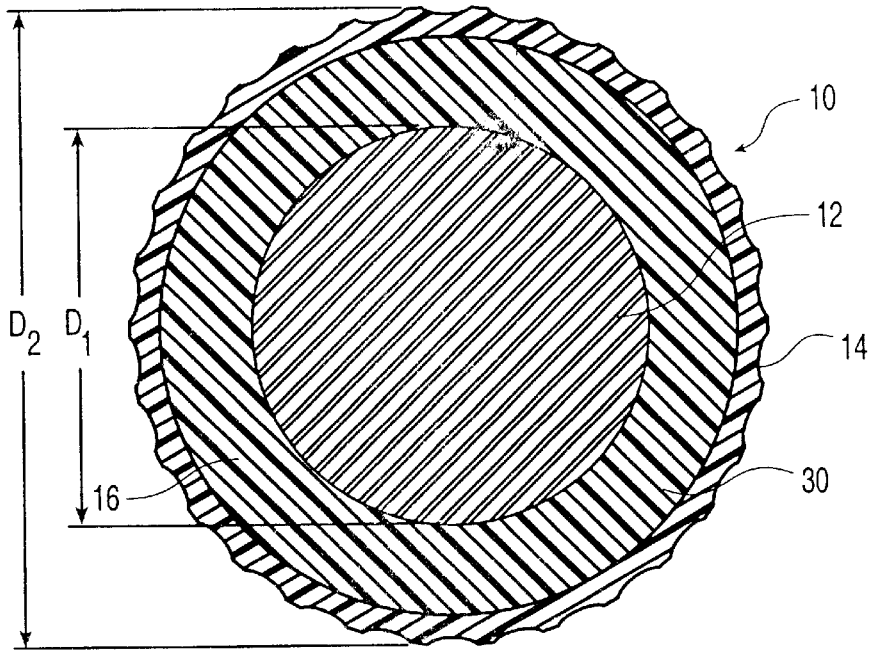
FIG. 1 is cross-sectional view of a first embodiment of a golf ball according to the present invention.
Figure 2:
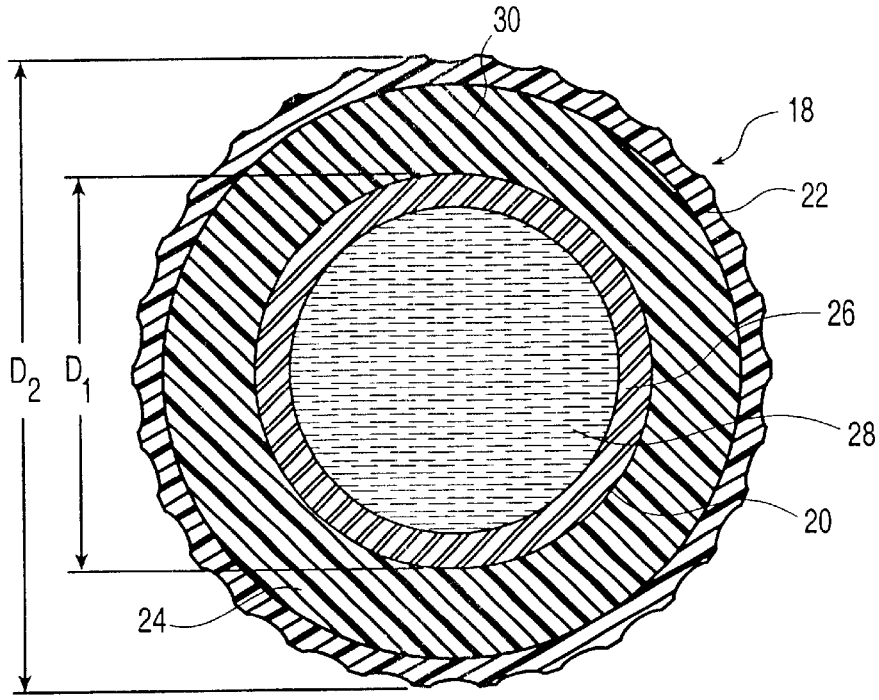
FIG. 2 is a cross-sectional view of a second embodiment of a golf ball according to the present invention.

Referring to FIGS. 1 and 2, golf balls 10 and 18 according to the present invention are shown. The golf balls are wound golf balls with high resilience for low swing speed players to give them greater distance off the tee. Methods for measuring the resiliency of golf balls are well known by those of ordinary skill in the art. One method of measuring the resiliency of a golf ball at impact is to utilize an air cannon or other means of propelling a ball at velocities equivalent to those of a golf club head. The balls are fired at a massive rigid block, with the inbound and outbound velocities being measured. The velocity may be measured by the use of light screens, which measure the time required for the ball to travel a fixed distance. The fixed distance divided by the transit time is equivalent to the average velocity of the ball over the fixed distance. The ratio of the outbound velocity to the inbound velocity is commonly referred to as the COR. The COR is a direct measure of the resilience of a golf ball. The present invention seeks to maximize the COR for low swing speed players to achieve greater distance and velocity off the tee, while conforming to USGA rules governing golf balls. These players usually swing the club at the ball at low swing speeds, and thus tend to obtain lower initial ball velocity after impact and less distance off the tee.

Figure 8:
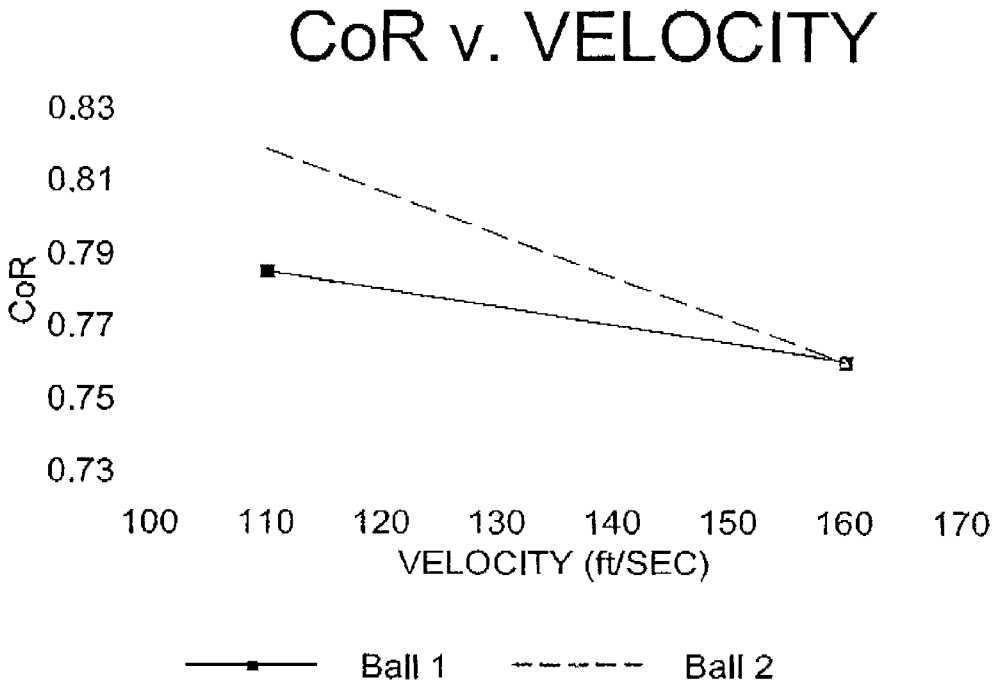
FIG. 8 is an illustration of COR versus inbound velocity for two golf balls.

The graph shown in FIG. 8 and the data of Table 1 provide an illustration of COR versus inbound velocity for two golf balls, including Ball no. 1, which is a conventional wound golf ball, and Ball no. 2 produced in accordance with this invention.

The change in COR with respect to velocity is greater for the golf ball made according to the present invention. The plot illustrates that golfers with swing speeds of 110 ft/s will obtain a substantially greater COR, and therefore greater ball velocity and distance, with a golf ball made according to the present invention compared to a conventional golf ball.

For example, Ball No. 1 and Ball No. 2, shown in FIG. 8, have the following values:

TABLE 1

| Ball # | COR @ 160 ft/s | Gradient (s/ft) | COR @ 110 ft/s |
|---|---|---|---|
| 1 | 0.760 | 0.0005 | 0.785 |
| 2 | 0.760 | 0.0011 | 0.815 |

Although both balls have the same COR values at 160 ft/s, Ball No. 2 will assist a lower swing speed player with added resiliency compared to Ball No. 1. This added resilience will increase distance and velocity off the tee for the lower swing speed player. The steeper the gradient, the more resilient the golf ball will be at lower swing speeds. The gradient can be calculated as follows:

$$\frac{COR@110\text{ ft/s} - COR@160\text{ ft/s}}{160\text{ ft/s} - 110\text{ ft/s}}$$

Since the greater the inbound velocity the lower the COR, it should be understood that balls prepared according to the present invention are intended for low swing speed players.

Referring to FIG. 1, a golf ball 10 according to the present invention is shown. The golf ball includes a center 12, a cover 14 and a layer of windings 16 disposed between the center and cover. As shown in FIG. 1, the center of the golf ball is solid. The center could be a thermoset solid rubber sphere, a thermoplastic solid sphere, wood, cork, metal, or any suitable material known to one of ordinary skill in the art. The center is covered with the wound layer, according to the present invention, and the cover.

A representative base composition for forming the solid golf ball center 12, which includes at least one layer as shown in FIG. 1, includes polybutadiene and, in parts by weight based on 100 parts polybutadiene, about 0 to about 50 parts of a metal salt diacrylate, dimethacrylate, or monomethacrylate, preferably zinc diacrylate, and about 0.01 to about 5 parts peroxide such as dicumyl peroxide. Exemplary commercial sources of polybutadiene include CARIFLEX® 1220 manufactured by H. MUEHLSTEIN & CO. INC. of Norwalk, Conn., NEOCIS® BR40 and BR60 manufactured by ENICHEM ELASTOMERS, INC. of New York, N.Y., and UBEPOL® BR150 manufactured by UBE INDUSTRIES, LTD. of New York, N.Y. If desired, the polybutadiene can also be mixed with other elastomers known in the art, such as natural rubber, styrene butadiene, and/or polyisoprene in order to further modify the properties of the center. When a mixture of elastomers is used, the amounts of other constituents in the core composition are based on 100 parts by weight of the total elastomer mixture. It should be understood that any suitable elastomer(s) may be used to form the center and any intermediate layer(s), but the elastomer preferably includes some type of polybutadiene.

Exemplary metal salt diacrylates, dimethacrylates, and monomethacrylates suitable for use in this invention include those wherein the metal is magnesium, calcium, zinc, aluminum, sodium, lithium or nickel. Zinc diacrylate is preferred, because it provides golf balls with a high initial velocity. The zinc diacrylate can be of various grades of purity. For the purposes of this invention, the lower the quantity of zinc stearate present in the zinc diacrylate, the higher the zinc diacrylate purity. Zinc diacrylate containing less than about 10 parts by weight zinc stearate is preferable. In one embodiment, zinc diacrylate contains about 4 to 8 parts by weight zinc stearate. Suitable, commercially available zinc diacrylates includes those from the Sartomer Corporation. A typical golf ball core incorporates 1 pph to 50 pph of zinc oxide in a zinc diacrylate-peroxide cure system that cross-links polybutadiene during the core molding process. The preferred concentrations of zinc diacrylate that can be used are about 0 to about 50 pph and preferably about 10 to about 30 pph, based upon 100 pph of polybutadiene or alternately, polybutadiene with a mixture of other elastomers that equal 100 pph.

Free radical initiators optionally but preferably are used to promote cross-linking of the metal salt diacrylate, dimethacrylate, or monomethacrylate and the polybutadiene. Suitable free radical initiators for use in the invention include, but are not limited to peroxide compounds, such as dicumyl peroxide, 1,1-di (t-butylperoxy) 3,3,5-trimethyl cyclohexane, a—a bis (t-butylperoxy) diisopropylbenzene, 2,5-dimethyl-2,5 di (t-butylperoxy) hexane, or di-t-butyl peroxide, and mixtures thereof. Other useful initiators would be readily apparent to one of ordinary skill in the art without any need for experimentation. The initiator(s) at 100% activity are preferably added in an amount ranging between about 0.05 pph and 5 pph based upon 100 parts of elastomer. More preferably, the amount of initiator added ranges from about 0.15 pph to 4 pph, and most preferably from about 0.25 pph to 3 pph.

The compositions of the present invention may also include fillers, added to the elastomeric composition to adjust the density and/or specific gravity of the core or to the cover. As used herein, the term "fillers" includes any compound or composition that can be used to vary the density and other properties of the subject golf ball core. Fillers useful in the golf ball core according to the present invention include, for example, zinc oxide, barium sulfate, flakes, fibers, and regrind, which is ground, recycled core material (for example, ground to about 30 mesh particle size). The amount and type of filler utilized is governed by the amount and weight of other ingredients in the composition, since a maximum golf ball weight of 45.93 g (1.62 ounces) has been established by the United States Golf Association (USGA). Appropriate fillers generally used have a specific gravity from about 2 to 20. In one preferred embodiment, the specific gravity can be about 2 to 6.

Fillers are typically polymeric or mineral particles. Exemplary fillers include precipitated hydrated silica; clay; talc; asbestos; glass fibers; aramid fibers; mica; calcium metasilicate; barium sulfate; zinc sulfide; lithopone; silicates; silicon carbide; diatomaceous earth; polyvinyl chloride; carbonates such as calcium carbonate and magnesium carbonate; metals such as titanium, tungsten, aluminum, bismuth, nickel, molybdenum, iron, lead, copper, boron, cobalt, beryllium, zinc, and tin; metal alloys such as steel, brass, bronze, boron carbide whiskers, and tungsten carbide whiskers; metal oxides such as zinc oxide, iron oxide, aluminum oxide, titanium oxide, magnesium oxide, and zirconium oxide; particulate carbonaceous materials such as graphite, carbon black, cotton flock, natural bitumen, cellulose flock, and leather fiber; micro balloons such as glass and ceramic; fly ash; and combinations thereof.

Antioxidants may also be included in the elastomer centers produced according to the present invention. Antioxidants are compounds which prevent the oxidative degradation of the elastomer. Antioxidants useful in the present invention include, but are not limited to, dihydroquinoline antioxidants, amine type antioxidants, and phenolic type antioxidants.

Other optional ingredients, such as accelerators, e.g., tetramethylthiuram, peptizers, processing aids, processing oils, plasticizers, dyes and pigments, as well as other additives well known to those of ordinary skill in the art may also be used in the present invention in amounts sufficient to achieve the purpose for which they are typically used.

One preferred optional additive is a cis-to-trans catalyst, which may be used with polybutadiene polymer. "Cis-to-trans catalyst" means any component or a combination thereof that will convert at least a portion of cis-polybutadiene isomer to trans-polybutadiene isomer at a given temperature. The cis-to-trans catalyst component includes at least one organosulfur component, preferably substantially free of metal; a substituted or unsubstituted aromatic organic component; an inorganic sulfide component; a Group VIA component; or a combination thereof.

Preferred organosulfur components include 4,4'-diphenyl disulfide, 4,4'-ditolyl disulfide, or 2,2'-benzamido diphenyl disulfide, or a mixture thereof. The organosulfur cis-to-trans catalyst, when present, is preferably present in an amount sufficient to produce the reaction product so as to contain at least about 12 percent trans-polybutadiene isomer, but typically is greater than about 32 percent trans-polybutadiene isomer based on the total resilient polymer component. Suitable metal-containing organosulfur components include, but are not limited to, cadmium, copper, lead, and tellurium analogs of diethyldithiocarbamate, diamyldithiocarbamate, and dimethyldithiocarbamate, or mixtures thereof. Preferred substituted or unsubstituted aromatic organic components that do not include sulfur or a metal include, but are not limited to, 4,4'-diphenyl acetylene, azobenzene, or a mixture thereof. Preferred inorganic sulfide components include, but are not limited to titanium sulfide, manganese sulfide, and sulfide analogs of iron, calcium, cobalt, molybdenum, tungsten, copper, selenium, yttrium, zinc, tin, and bismuth. The cis-to-trans catalyst may also be a blend of an organosulfur component and an inorganic sulfide component.

A substituted or unsubstituted aromatic organic compound may also be included in the cis-to-trans catalyst. In one embodiment, the aromatic organic compound is substantially free of metal. Preferred substituted or unsubstituted aromatic organic components include, but are not limited to, components having the formula $(R_1)_x—R_3—M—R_4—(R_2)_y$, wherein x and y are each an integer from 0 to 5; M includes an azo group or a metal component; $R_3$ and $R_4$ are each preferably selected from a $C_6$ to $C_{10}$ aromatic group, more preferably selected from phenyl, benzyl, naphthyl, benzamido, and benzothiazyl; and $R_1$ and $R_2$ are each preferably selected from a substituted or unsubstituted $C_{10}$ linear, branched, or cyclic alkyl, alkoxy, or alkylthio group or a $C_6$ to $C_{10}$ aromatic group. When $R_1$, $R_2$, $R_3$, or $R_4$, are substituted, the substitution may include one or more of the following substituent groups: hydroxy and metal salts thereof; mercapto and metal salts thereof; halogen; amino, nitro, cyano, and amido; carboxyl including esters, acids, and metal salts thereof; silyl; acrylates and metal salts thereof; sulfonyl or sulfonamide; and phosphates and phosphites. When M is a metal component, it may be any suitable elemental metal available to those of ordinary skill in the art. Typically, the metal will be a transition metal, although preferably it is tellurium or selenium. In one embodiment, the aromatic component has the formula:

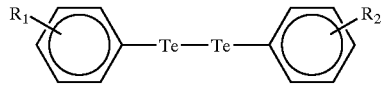

In one preferred embodiment, the aromatic component for use in the cis-to-trans catalyst has the formula:

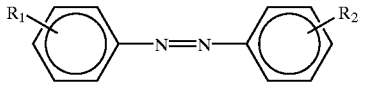

In the first of these two structures, selenium may be used in place of the tellurium if desired. In a most preferred embodiment, $R_3$ and $R_4$ are each a $C_6$ aryl group and M includes an azo group.

The cis-to-trans catalyst can also include a Group VIA component. Elemental sulfur and polymeric sulfur are commercially available from, e.g., Elastochem, Inc. of Chardon, Ohio. Exemplary sulfur catalyst compounds include PB(RM-S)-80 elemental sulfur and PB(CRST)-65 polymeric sulfur, each of which is available from Elastochem, Inc. An exemplary tellurium catalyst under the tradename TELLOY and an exemplary selenium catalyst under the tradename VANDEX are each commercially available from RT Vanderbilt.

The optional cis-to-trans catalyst, when present, is preferably included in an amount from about 0.1 to 25 parts per hundred of the total resilient polymer component. More preferably, the cis-to-trans catalyst is present in an amount from about 0.1 to 12 parts per hundred of the total resilient polymer component. Most preferably, the cis-to-trans catalyst is present in an amount from about 0.1 to 8 parts per hundred of the total resilient polymer component. The cis-to-trans catalyst is typically present in an amount sufficient to produce the reaction product so as to increase the trans-polybutadiene isomer content to contain from about 5 percent to 70 percent trans-polybutadiene based on the total resilient polymer component. A more complete list of optional cis-to-trans catalyst materials suitable for use in accordance with the present invention may be found in one or more of the following copending applications, each of which is hereby incorporated herein by express reference thereto: Ser. Nos. 09/307,753, filed May 10, 1999; 09/461,735, filed Dec. 16, 1999; 09/458,676, filed Dec. 10, 1999; and 09/461,421, filed Dec. 16, 1999.

Similarly, as shown in FIG. 2, a golf ball 18 is shown having a center 20, a cover 22 and a layer of windings 24 disposed between the center and cover. The center is a liquid-filled sphere or shell 26, such as a rubber sack, a thermoplastic, or metallic shell design. The liquid 28 employed could be of any suitable composition or viscosity. It is also feasible to construct such a center with a void (hollow) or "gas" center. The center is covered with an optional intermediate layer (not shown), the wound layer, and the cover according to the present invention.

The envelope or shell 26 can be filled with a wide variety of materials for fluid including air, gas, water solutions, gels, foams, hot-melts, other fluid materials and combinations thereof, such as those set forth in U.S. Pat. No. 5,683,312, which is incorporated herein by reference. The fluid or liquid in the center can be varied to modify the performance parameters of the ball, such as the moment of inertia, weight, initial spin, and spin decay.

Suitable gases included in the fluid-filled center include air, nitrogen and argon. Preferably, the gas is inert. Examples of suitable liquids include either solutions such as salt in water, corn syrup, salt in water and corn syrup, glycol and water or oils. The liquid can further include water soluble or dispersable organic compounds, pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which are solid at or about normal room temperatures but become liquid at elevated temperatures become liquid.

The fluid can also be a reactive liquid system which combines to form a solid or create internal pressure within the envelope. Examples of suitable reactive liquids that form solids are silicate gels, agar gels, peroxide cured polyester resins, two part epoxy resin systems and peroxide cured liquid polybutadiene rubber compositions. Of particular interest are liquids that react to form expanding foams. It is understood by one of ordinary skill in the art that other reactive liquid systems can likewise be utilized depending on the physical properties of the envelope and the physical properties desired in the resulting finished golf balls.

Preferably, the center 12 and 18 of FIGS. 1 and 2 has an outer diameter $D_1$ of at least about 1.1 inches, more preferably about 1.2 to 1.5 inches. Preferably, the wound layer, 16 and 24, respectively, has an outer diameter $D_2$ of about 1.4 to 1.62 inches, more preferably 1.5 to 1.6 inches. The layer of windings of the golf balls is formed by at least one thread 30. Thus, the amount of thread used tends to be small in comparison with the size of the core. The wound layer lowers compression and results in a ball having a softer feel. The golf balls made according to the present invention have a COR at 160 ft/s of at least 0.76, preferably at least about 0.761 and a gradient of the COR to an inbound velocity of at least about 0.0010 s/ft.

Thread materials including polyisoprene, polyether urea, polyester, polyethylene,polypropylene, or combinations thereof may be used with the present invention. Relatively high and low modulus threads may be wound simultaneously around a center. Moreover, in another embodiment, a thread that "softens" during the compression and/or injection molding cycles, creating a "mantle" layer or a fused cover, such as polyether urea could be used. Also, a thread that does not exhibit softening during molding, such as polyisoprene, may be used with the present invention. It is preferred to use thread including polyether urea in the wound layer.

Threads used in the present invention may be formed using a variety of processes including conventional calendering and slitting. Furthermore, processes such as melt spinning, wet spinning, dry spinning or polymerization spinning may also be used to provide threads. Melt spinning is a highly economic process. Polymers are extruded through spinnerets by a heated spin pump. The resulting fibers are drawn off at rates up to 1200 m/min. The fibers are drawn and allowed to solidify and cool in the air. Because of the high temperatures required, only melting and thermally stable polymers can be melt spun. These polymers include poly(olefins), aliphatic polyamides, and aromatic polyesters, all of which are suitable thread materials.

For polymers that decompose on melting, the wet spinning method is used. Solutions of about 5 to 20% are passed through the spinnerets by a spin pump. A precipitation bath is used to coagulate the filaments and a drawing or stretching bath is used to draw the filaments. Filament production rates under this method are lower than melt spinning, typically about 50 to 100 m/min. Because of solvent recovery costs, this method is, less economical.

In dry spinning, air is the coagulating bath. The method is usable for polymers that decompose on melting, however only when readily volatile solvents are known for the polymers. Solutions of about 20 to 55% are used. After leaving spinneret orifices, resulting filaments enter a chamber having a length of about 5 to 8 m. In the chamber, jets of warm air are directed toward the filaments. This causes the solvent to evaporate and the filaments to solidify. The process has higher rates of spinning than the wet spinning process. Typically, filament production rates are about 300 to 500 m/min. The initial capital investment of equipment is higher, but the operation costs are lower than in wet spinning. Further, this process is only usable for spinning polymers for which readily volatile solvents are known.

In another method of spinning, polymerization spinning, a monomer is polymerized together with initiators, fillers, pigments, and flame retardants, or other selected additives. The polymerizate is directly spun at rates of about 400 m/min. The polymerizate is not isolated. Only rapidly polymerizing monomers are suitable for this method. For example, LYCRA® is produced by polymerization spinning.

Figure 3:
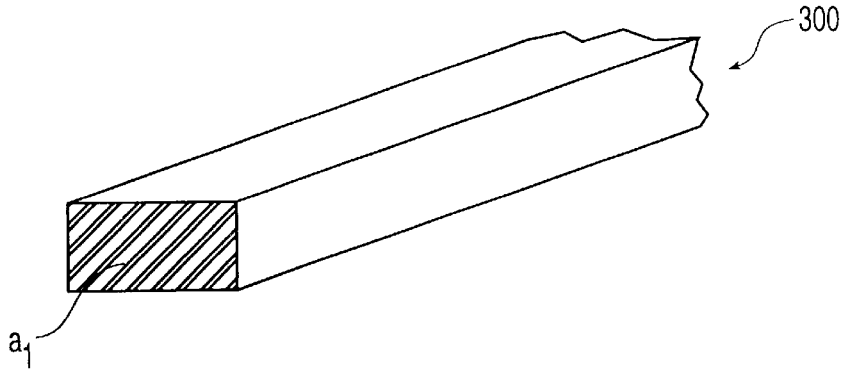
FIG. 3 is an enlarged, partial perspective view of a conventional single-ply thread for use in a golf ball of the present invention.

Many different kinds of threads are usable with the present invention. For example, referring to FIG. 3, a conventional single-ply golf ball thread 300 is shown. In general, the single-ply golf ball thread 300 is formed by mixing synthetic cis-polyisoprene rubber, natural rubber and a curing system together, calendering this mixture into a sheet, curing the sheet, and slitting the sheet into threads. The thread is generally rectangular and its dimensions are preferably 0.0625×0.02 inches. The typical area of the thread 300 is $a_1$, which is generally about 0.0013 $in^2$. This material can be applied in a very thin layer over the center.

Figure 4:
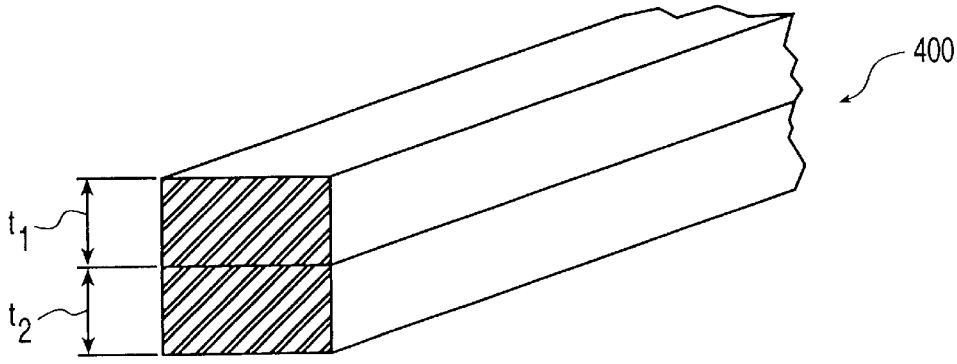
FIG. 4 is an enlarged, partial perspective view of a conventional two-ply thread for use in a golf ball of the present invention, but FIG. 4 is not necessarily scaled in comparison to the other FIGS.

Referring to FIG. 4, a conventional two-ply golf ball-thread 400 is shown that is also usable with the present invention. In the case of the two-ply golf ball thread, the mixture and calendering steps are the same as on the single-ply thread. However, after the sheets are thus formed, they are calendered together, cured to bond the plies or sheets together and slit into threads. Each ply of the thread 400 has a thickness, $t_1$ and $t_2$, respectively. Generally, these thicknesses are substantially the same and each ply also has the same physical properties.

Figure 5:
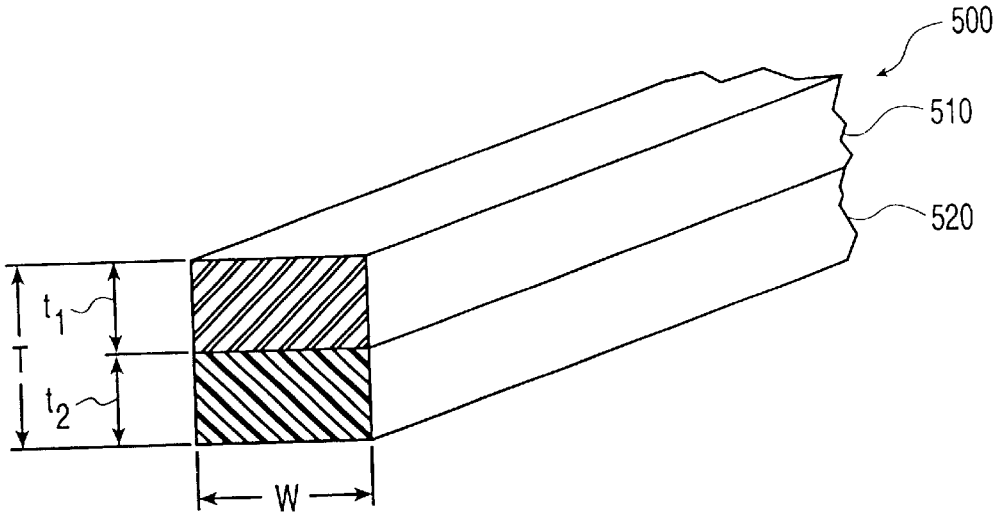
FIG. 5 is an enlarged, partial perspective view of another two-ply thread for use in the golf ball of the present invention, but FIG. 5 is not necessarily scaled in comparison to the other FIGS.

As shown in FIG. 5, another two-ply thread, usable with the present invention, is formed by the conventional techniques of mixing the thread materials, calendering the thread materials into sheets of the two plies, calendering the sheets or plies together, connecting the plies together, and slitting the sheets into two threads 500. The step of connecting the plies together can be by vulcanizing the material while the two plies are held together under pressure, which will bond the plies together. The vulcanization system is a sulfur bearing system that is activated by heat and known by those of ordinary skill in the art. Preferably, the first ply 510 is more resilient and the second ply 520 is more processable, as evidenced by the physical properties of each ply.

Figure 6:
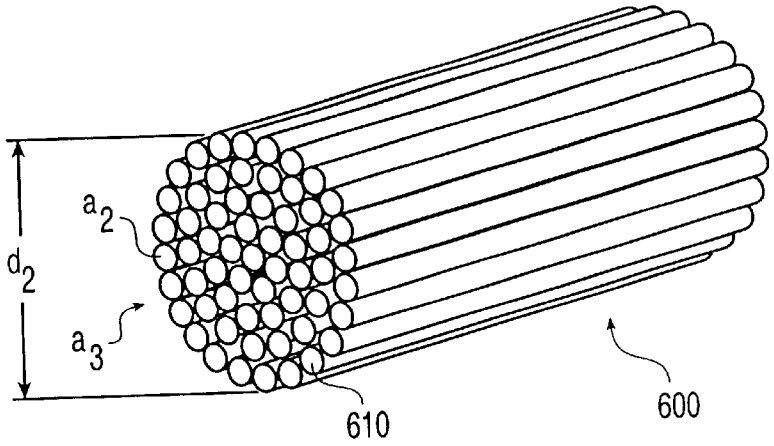
FIG. 6 is an enlarged, partial perspective view of a thread for use in the golf ball of the present invention, but FIG. 6 is not necessarily scaled in comparison to the other Figs.

Another type of thread usable in the present invention is shown in FIG. 6. Thread 600 is comprised of many individual filaments or strands 610. Preferably over 10 strands 610 make up the thread 600, and more preferably over 50 strands 610 form the thread 600. Most preferably, the thread contains greater than 100 strands. The strands 610 have a small diameter, typically of a diameter of less than about 0.002 inches, and more preferably less than about 0.0001 inches. Preferably, the strands of the present invention have a cross-sectional area $a_2$ of less than about 0.0001 $in^2$ and most preferably less than about 0.00001 $in^2$. Preferably, the thread of the present invention has a cross-sectional area $a_3$ of less than about 0.001 $in^2$ and most preferably less than about 0.0005 $in^2$.

Preferably, the thread has an elongation to break of greater than about 8%. More preferably, the thread has an elongation to break of greater than about 25%. A minimum of about 8% thread elongation prior to breakage allows the golf ball to deform during impact. A golf ball where the thread deforms significantly less than about 8% during a typical driver impact will feel hard when struck and will have undesirable spin and feel characteristics. Preferably, the elastic modulus of the thread in the wound state is greater than about 10,000 psi. More preferably, the elastic modulus is greater than about 25,000 psi.

The strands 610 of the thread 600 of FIG. 6 may be held together with a binder as shown or they may be spun together. Melt spinning, wet spinning, dry spinning, and polymerization spinning may be used to produce the threads. Each method was discussed in more detail previously.

The thread 600 of FIG. 6 is preferably comprised of a polymeric material. Suitable polymers include polyether urea, such as LYCRA®; polyester urea; polyester block copolymers, such as HYTREL®; isotactic-poly(propylene); polyethylene; polyamide; poly(oxymethylene); polyketone; poly(ethylene terephthalate), such as DACRON®; poly(p-phenylene terephthalamide), such as KEVLAR®; poly (acrylonitrile), such as ORLON®; trans,trans-diaminodicyclohexylmethane and dodecanedicarboxylic acid, such as QUINA®. LYCRA®, HYTREL®, DACRON®, KEVLAR®, ORLON®, and QUINA® are available from E.I. DuPont de Nemours & Co. of Wilmington, Del. Glass fiber and, for example, S-GLASS® from Coming Corporation can also be used. Also, D7 Globe thread by Globe Manufacturing of Fall River, Mass. can be used.

The thread 600 may also be comprised of strands 610 having different physical properties to achieve desired stretch and elongation characteristics. For example, the thread may include strands of a first elastic type of material that is weak but resilient and also strands of a second elastic type of material that is stronger but less resilient. In another example, the thread may include at least one strand of polyisoprene rubber thread having a diameter of less than about 0.02 inches. This strand may be surrounded by about 10 to 50 polyether urea strands each having a diameter of less than about 0.002 inches.

The golf balls 10 of FIGS. 1 and 2 may be made by any conventional process employed in the golf ball art. For example, the golf ball of FIG. 1 can be manufactured by injection or compression molding the solid center 12. The thread 30 is then wound about the solid center 12 to form the wound layer 16 as previously described. The cover layer or layers 14 can then be injection or compression molded or cast about the wound layer 16 by processes which are well known in the art. Most preferably, the golf ball according to the present invention has a solid center, and is wound with a polyether urea LYCRA® thread having at least about 100 strands, the strands each having a diameter of about 0.0001 inches and wound at an elongation of about 200 to about 500%.

Turning to FIG. 2, a golf ball 18 of the present invention can be formed by initially forming the shell 26 by compression molding hemispherical cups, the cups are bonded together to form the shell to create a cavity and filling the cavity with fluid or liquid 28 to form the fluid filled center 20. The thread 30 is then wound around the shell to form the wound layer as previously described. The cover can then be injection or compression molded or cast about the wound layer.

Figure 7:
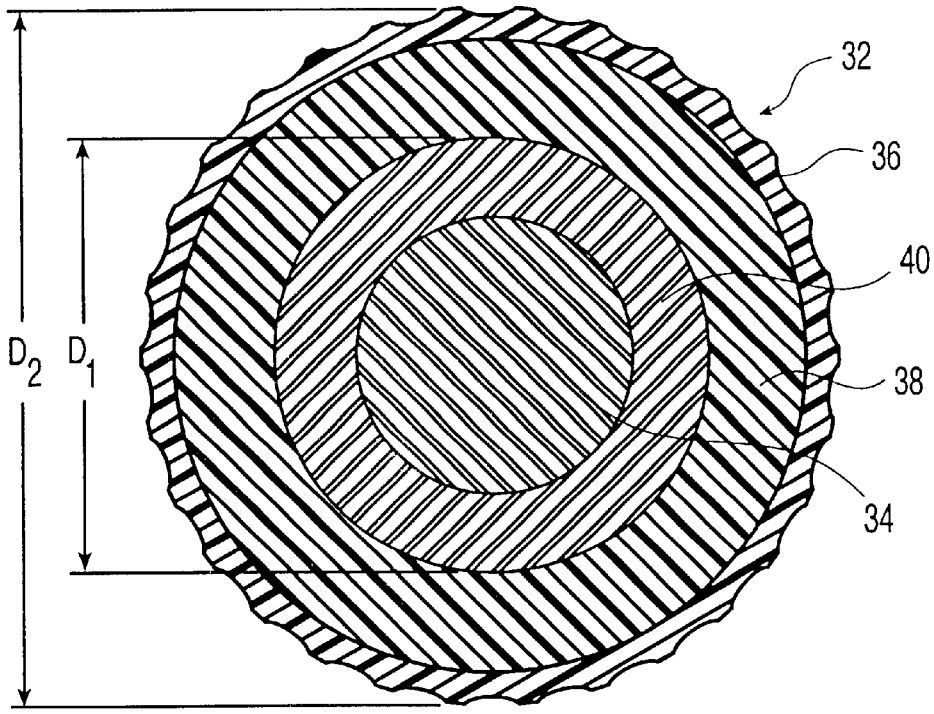
FIG. 7 is a cross-sectional view of a golf ball according to the present invention having an additional layer.

Referring to FIG. 7, a golf ball 32 is shown having a solid center 34, a cover 36 and a wound layer 38 disposed between the center and the cover. The center 34 may also be a liquid filled center formed as described above. An additional layer or layers 40 is formed over the center. For example, as shown in FIG. 7, a mantle layer 40 is formed over the center. A wound layer, according to the present invention as described above, is formed over the mantle layer of at least one thread. A cover is formed over the wound layer. The cover is formed as previously described. Moreover, there are many variations of FIG. 7, including forming the wound layer, according to the present invention, immediately adjacent the center, with the conventional mantle layer formed over the wound layer. Furthermore, it is conceivable that instead of a solid mantle layer, a second wound layer or layers could be formed either between the center and the wound layer according to the present invention, or between the wound layer according to the present invention and the cover. Numerous materials, as previously described herein could be used to form these additional layers.

Referring to FIGS. 1, 2 and 7, the cover 14, 22 and 36 provides the interface between the ball and a club. Properties that are desirable for the cover are good moldability, high abrasion resistance, high tear strength, high resilience, and good mold release, among others. In accordance with the preferred balls, the cover has a thickness to generally provide sufficient strength, good performance characteristics and durability. Preferably, the cover is of a thickness from about 0.03 inches to about 0.12 inches. More preferably, the cover is about 0.04 to 0.09 inches in thickness and, most preferably, is about 0.05 to 0.085 inches in thickness. Where the cover is provided by casting, the cover thickness is most preferably from about 0.03 to 0.05 inches. The cover can be formed of materials, such as balata, ionomers, metallocene-catalyzed polymers, polyurethanes, or a mixture thereof. The cover can have two layers where the first layer surrounds the core and the second layer surrounds the first layer.

The cover 14, 22 and 34 of the golf ball can be comprised of one or more layers and is generally made of polymeric materials such as ionic copolymers of ethylene and an unsaturated monocarboxylic acid which are available under the trademark SURLYN® of E.I. DuPont de Nemours & Co. of Wilmington, Del. or IOTEK® or ESCOR® from Exxon of Irving, Tex. These are copolymers or terpolymers of ethylene and methacrylic acid or acrylic acid partially neutralized with zinc, sodium, lithium, magnesium, potassium, calcium, manganese, nickel, or the like, or combinations or blends thereof. In another embodiment, the cover can be formed from mixtures or blends of zinc, lithium and/or sodium ionic copolymers or terpolymers.

Also, SURLYN® resins for use in the cover are ionic copolymers or terpolymers in which sodium, lithium or zinc salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The invention can likewise be used in conjunction with covers having one or more homopolymeric and copolymer materials such as:

(1) Vinyl resins such as those formed by the polymerization of vinyl chloride, or by the copolymerization of vinyl chloride with vinyl acetate, acrylic esters or vinylidene chloride.

(2) Polyolefins such as polyethylene, polypropylene, polybutylene and copolymers such as ethylene methylacrylate, ethylene ethylacrylate, ethylene vinyl acetate, ethylene methacrylic or ethylene acrylic acid or propylene acrylic acid and copolymers and homopolymers produced using single-site catalyst.

(3) Polyurethanes such as those prepared from polyols and diisocyanates or polyisocyanates and those disclosed in U.S. Pat. No. 5,334,673.

(4) Polyureas such as those disclosed in U.S. Pat. No. 5,484,870.

(5) Polyamides such as poly(hexamethylene adipamide) and others prepared from diamines and dibasic acids, as well as those from amino acids such as poly (caprolactam), and blends of polyamides with Surlyn, polyethylene, ethylene copolymers, ethyl-propylene-non-conjugated diene terpolymer, etc.

(6) Acrylic resins and blends of these resins with poly vinyl chloride, elastomers, etc.

(7) Thermoplastics such as the urethanes, olefinic thermoplastic rubbers such as blends of polyolefins with ethylene-propylene-non-conjugated diene terpolymer, block copolymers of styrene and butadiene, isoprene or ethylene-butylene rubber, or copoly(ether-amide), such as PEBAX® sold by ELF-Atochem.

(8) Polyphenylene oxide resins, or blends of polyphenylene oxide with high impact polystyrene as sold under the trademark NORYL® by General Electric Company, Pittsfield, Mass.

(9) Thermoplastic polyesters, such as polyethylene terephthalate, polybutylene terephthalate, polyethylene terephthalate/glycol modified and elastomers sold under the trademarks HYTREL® by E.I. DuPont de Nemours & Co. of Wilmington, Del. and LOMOD® by General Electric Company, Pittsfield, Mass.

(10) Blends and alloys, including polycarbonate with acrylonitrile butadiene styrene, polybutylene terephthalate, polyethylene terephthalate, styrene maleic anhydride, polyethylene, elastomers, etc. and polyvinyl chloride with acrylonitrile butadiene styrene or ethylene vinyl acetate or other elastomers. Blends of thermoplastic rubbers with polyethylene, propylene, polyacetal, nylon, polyesters, cellulose esters, etc.

Preferably, the cover includes polymers such as ethylene, propylene, butene-1 or hexane-1 based homopolymers and copolymers, including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly (ethylene terephthalate), poly(butylene terephthalate), poly (ethylene vinyl alcohol), poly(tetrafluoroethylene) and their copolymers including functional comonomers, and blends thereof. Still further, the cover preferably includes a polyether or polyester thermoplastic urethane, a thermoset polyurethane, an ionomer such as acid-containing ethylene copolymer ionomers, including E/X/Y terpolymers where E is ethylene, X is an acrylate or methacrylate-based softening comonomer present in 0 to 50 weight percent and Y is acrylic or methacrylic acid present in about 5 to 35 weight percent, or a combination thereof. More preferably, in a low spin rate embodiment designed for maximum distance, the acrylic or methacrylic acid is present in about 15 to 35 weight percent, making the ionomer a high modulus ionomer. In a high spin embodiment, the cover includes an ionomer where an acid is present in about 10 to 15 weight percent and includes a softening comonomer.

The covers of the present invention may also include a castable reactive material, such as polyurethane or an ionomer thereof. U.S. Pat. Nos. 5,334,673, 5,692,974, and 5,733,428, which are incorporated herein by reference, disclose golf ball covers comprising various thermosetting polyurethanes and blends thereof. Additionally or alternatively, the covers can include a reaction injection moldable reactive material, such as polyurethane or an ionomer thereof.

When golf balls are prepared according to the invention, they typically will have dimple coverage greater than about 60 percent, preferably greater than about 65 percent, and more preferably greater than about 70 percent. As measured by ASTM method D-790, the flxural modulus of the cover material for use on the golf balls is typically greater than about 500, psi, and is preferably from about 500 psi to 150,000 psi. The hardness of the cover material is typically from about 35 to 80 Shore D, preferably from about 40 to 78 Shore D, and in one preferred embodiment, from about 45 to 75 Shore D. The golf balls also typically have a compression of at least about 40, preferably from about 50 to 120, and more preferably from about 60 to 100. The specific gravity of the golf ball polybutadiene material is typically greater than about 0.7, and in one preferred embodiment can be greater than about 1.

Additionally, any unvulcanized rubber, such as polybutadiene, used in golf balls prepared according to the invention typically has a Mooney viscosity greater than about 20, preferably greater than about 30, and more preferably greater than about 40. Mooney viscosity is typically measured according to ASTM D-1646.

EXAMPLES

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims. Test results for these example balls are shown in Table 2 in comparison to test results from golf balls currently on the market.

Example 1

A golf ball was made according to the present invention. The golf ball had a 1.538 inch diameter solid center made of conventional polybutadiene materials. The solid center was wound to 1.565,inches with LYCRA® made by E.I. DuPont de Nemours & Co. of Wilmington, Del., (DuPont) a polyether urea thread, at an elongation of approximately 300%. A cover made of sodium-lithium SURLYN blend was formed over the wound layer. The golf ball had an outer diameter of 1.678 inches. The golf ball was tested and found to have a COR at 160 ft/s of 0.777, and 0.827. at 110 ft/s and a gradient of 0.00100.

Example 2

A second golf ball according to the present invention was made. The golf ball had a 1.5 inch diameter solid center made of conventional polybutadiene materials. The solid center was wound to 1.565 inches with a LYCRA® material made by DuPont. The thread was wound at an elongation of approximately 300%. A cover was formed over the thread. The cover was made of sodium-lithium SURLYN blend, and the outer diameter of the golf ball was 1.679 inches. The golf ball was tested and found to have a COR at 160 ft/s of 0.778, and 0.829 at 110 ft/s and a gradient of 0.00102.

Example 3

A third golf ball was made according to the present invention. The golf ball had a 1.388 inch diameter solid center made of conventional polybutadiene materials. The center was wound to 1.565 inches with a LYCRA® material made by Dupont. The thread was wound at an elongation of approximately 300%. A cover, made of sodium-lithium SURLYN blend, was formed over the wound layer. The golf ball had an outer diameter of 1.682 inches. The golf ball was tested and found to have a COR at 160 ft/s of 0.773, and 0.825 at 110 ft/s and a gradient of 0.00104.

Example 4

A fourth golf ball was made according to the present invention. The golf ball had a 1.388 inch diameter solid center made of conventional polybutadiene materials. The center was wound with a LYCRA® material, made by DuPont, to 1.565 inches. The thread was wound at an elongation of approximately 300%. A cover made of sodium-lithium SURLYN blend was formed over the wound layer and the outer diameter of the golf ball was 1.682 inches. The golf ball was tested and found to have a COR at 160 ft/s of 0.761, and 0.818 at 110 ft/s and a gradient of 0.00113.

Example 5

A fifth golf ball was made according to the present invention. The golf ball had a 1.388.inch diameter solid center made of conventional polybutadiene materials. The center was wound with a Globe thread, a polyether urea thread made by Globe Manufacturing of Fall River, Mass., to a diameter of 1.565 inches. The thread was wound at an elongation of approximately 300%. A cover made of sodium-lithium SURLYN blend was formed over the wound layer and had an outer diameter of 1:681 inches. The golf ball was tested and found to have a COR at 160 ft/s of 0.759, and 0.817 at 110 ft/s and a slope or gradient of 0.00117.

TABLE 2

| Examples | COR (@ 110) | COR (@ 160) | Gradient |
|---|---|---|---|
| Example C1 | 0.788 | 0.766 | 0.00044 |
| Example C2 | 0.801 | 0.778 | 0.00047 |
| Example C3 | 0.810 | 0.757 | 0.00107 |
| Example C4 | 0.803 | 0.768 | 0.00070 |
| Example 1 | 0.827 | 0.777 | 0.00100 |
| Example 2 | 0.829 | 0.778 | 0.00102 |
| Example 3 | 0.825 | 0.773 | 0.00104 |
| Example 4 | 0.818 | 0.761 | 0.00113 |
| Example 5 | 0.817 | 0.759 | 0.00117 |

As is shown by the above examples, golf balls according to the present invention (Examples 1–5) have, a COR of at least 0.76 at 160 ft/s and have a COR gradient of at least 0.0001 s/ft. As is shown in the above table, the golf balls of the present invention have higher COR at 110 ft/s than golf balls currently on the market, as shown by comparative examples C1–C4. Further, the gradient is larger than those currently on the market. Thus, the golf balls of the present invention are more resilient than those currently on the market for low swing speed players and will provide greater distance and velocity off the tee for these players.

The term "about," as used herein in connection with one or more numbers or numerical ranges, should be understood to refer to all such numbers, including all numbers in a range.

While it is apparent that the illustrative embodiments of the invention herein disclosed fulfills the objectives stated above, it will be appreciated that numerous modifications and other embodiments maybe devised by those skilled in the art. For example, the present invention could use more than one thread where the threads are chemically, physically or mechanically distinct from each other. Moreover, the golf ball may be formed with additional layers. For example, a wound layer of the present invention may be formed over a mantle layer formed over a center. Therefore, it will be understood that the appended claims are intended to cover all such modifications and embodiments which come within the spirit and scope of the present invention.

What is claimed is:

1. A golf ball comprising:

a center, a cover, and a wound layer comprising at least one thread material disposed between the center and the cover, each thread having at least one strand, wherein the coefficient of restitution of the golf ball at 160 ft/s is about 0.76 or greater and the magnitude of the gradient of the coefficient of restitution to an inbound velocity is about 0.0001 s/ft or greater.

2. The golf ball of claim 1, wherein the cover material has at least one of a dimple coverage of greater than about 60 percent, a hardness from about 35 to 80 Shore D, or a flexural modulus of greater than about 500 psi, and wherein the golf ball has a compression from about 50 to 120.

3. The golf ball of claim 1 herein the center has a diameter of at least about 1.1 inches.

4. The golf ball of claim 3 wherein the diameter of the center is about 1.2 to about 1.5 inches.

5. The golf ball of claim 1 wherein the wound layer has an outer diameter of about 1.4 inches to about 1.62 inches.

6. The golf ball of claim 1 wherein the thread comprises polyether urea.

7. The golf ball of claim 1 wherein the thread comprises at least about 10 strands.

8. The golf ball of claim 7 wherein the thread comprises at least about 100 strands.

9. The golf ball of claim 1 wherein the thread comprises a plurality of strands each having a diameter of about 0.02 inches or greater.

10. The golf ball of claim 9 wherein the diameter of each strand is at most about 0.001 inches.

11. The golf ball of claim 6 wherein the thread is wound at an elongation of at least about 200%.

12. The golf ball of claim 11 wherein the thread is wound at an elongation of about 200% to about 500%.

13. The golf ball of claim 1, wherein the thread is elongated to at least about 10%.

14. The golf ball of claim 1 wherein the center is solid or hollow.

15. The golf ball of claim 1 wherein the center is solid and comprises polybutadiene, natural rubber, polyisoprene or a combination thereof.

16. The golf ball of claim 1 wherein the center is fluid-filled.

17. The golf ball of claim 1, further comprising at least one intermediate layer disposed between the center and cover.

18. The golf ball of claim 1, wherein the ball weighs less than about 44 g.

19. A golf ball comprising:

a center;

a cover, and a wound layer comprising at least one thread material disposed between the center and the cover, each thread having at least one strand, wherein the coefficient of restitution of the golf ball at 160 ft/s is about 0.76 or greater and the magnitude of the gradient of the coefficient of restitution to an inbound velocity is about 0.0001 s/ft or greater, and wherein at least one of the center, the cover, or the wound layer comprises a material formed from the conversion reaction of an amount of polybutadiene, a free radical source, and a cis-to-trans catalyst, which reaction occurs at a sufficient temperature to form a polybutadiene reaction product comprising an amount of trans-polybutadiene greater than the amount of trans-polybutadiene present before the conversion reaction.

20. The golf ball of claim 19, wherein the reaction product has a first dynamic stiffness measured at −50° C. that is less than about 130 percent of a second dynamic stiffness measured at 0° C.

21. The golf ball of claim 19, wherein the cis-to-trans catalyst comprises at least one of a Group VIA element, an inorganic sulfide, an aromatic organic compound, an organosulfur component, or a combination thereof.

22. The golf ball of claim 19, wherein the cis-to-trans catalyst is present in an amount from about 0.01 to 25 parts per hundred of polybutadiene.

23. The golf ball of claim 19, wherein the reaction product is disposed in at least a portion of the center or the wound layer.

24. The golf ball of claim 23, wherein the thread material is tensioned and comprises the reaction product.

25. A method of making the golf ball of claim 1, comprising:

combining (a) a cis-to-trans catalyst; (b) a fine radical source; and (c) a first resilient polymer component comprising a cis-polybutadiene component present in an amount greater than about 70 percent of the total polymer component;

converting a portion of the first resilient polymer component to a second resilient polymer component in about 5 to 18 minutes at a sufficient temperate to convert at least a portion of the cis-polybutadiene component to a trans-polybutadiene component and wherein the polybutadiene in the second resilient polymer component is at least about 10 percent trans-polybutadiene and less than about 7 percent vinyl-polybutadiene; and forming the second resilient polymer component into at least a portion of the center, the wound layer, or the cover of the golf ball.

26. A golf ball comprising;

a core having;

a center having a diameter of about 1.1 inch or greater, a cover, and a wound layer disposed about the center, wherein the coefficient of restitution of the golf ball at 160 ft/s is about 0.76 or greater and the magnitude of the gradient of the coefficient of restitution to an inbound velocity is at least 0.001 s/ft.

27. A golf ball comprising:

a center;

a cover; and a wound layer comprising at least one thread material disposed between the center and the cover, each thread having at least one strand, wherein the coefficient of restitution of the golf ball at 160 ft/s is about 0.77 or greater and the magnitude of the gradient of the coefficient of restitution to an inbound velocity is about 0.0012 s/ft or greater.

* * * * *